United States Patent [19]

Steffinger

[11] Patent Number: 4,734,054

[45] Date of Patent: Mar. 29, 1988

[54] PLUG CONNECTOR

[75] Inventor: Karl Steffinger, Munich, Fed. Rep. of Germany

[73] Assignee: Siemens Aktiengesellschaft, Berlin and Munich, Fed. Rep. of Germany

[21] Appl. No.: 875,970

[22] Filed: Jun. 19, 1986

[30] Foreign Application Priority Data

Jul. 8, 1985 [DE] Fed. Rep. of Germany ..... 3524374

[51] Int. Cl.[4] ..... H01R 4/24

[52] U.S. Cl. ..... 439/399; 439/407

[58] Field of Search ..... 339/97 R, 97 P, 99 R, 339/98 R; 439/389, 391, 395, 397–400, 406, 407

[56] References Cited

U.S. PATENT DOCUMENTS

| | | | |
|---|---|---|---|
| 3,713,073 | 1/1973 | Narozny | 339/17 F |
| 3,926,498 | 12/1975 | Hoppe, Jr. | 339/97 R |
| 4,255,009 | 3/1981 | Clark | 339/97 P |
| 4,277,124 | 7/1981 | Loose et al. | 339/99 R |
| 4,327,956 | 5/1982 | Sitzler | 339/107 |
| 4,327,958 | 5/1982 | Hughes et al. | 339/97 R X |
| 4,350,404 | 9/1982 | Clark et al. | 339/97 R |

FOREIGN PATENT DOCUMENTS

| | | | |
|---|---|---|---|
| 1665757 | 10/1971 | Fed. Rep. of Germany . | |
| 2454191 | 12/1980 | France | 339/97 R |
| 2043368 | 10/1980 | United Kingdom . | |

*Primary Examiner*—John McQuade

*Attorney, Agent, or Firm*—Hill, Van Santen, Steadman & Simpson

[57] ABSTRACT

The contact elements of the plug connector are engaged into chambers of an insulating strip by means of a conductor terminal component which has cutting and clamping contact edges. The chambers are only open towards a flat side of the strip, so that a conductor can be pressed into the contacting slots of the cutting and clamping contact points from the open side of the chambers. This allows an uncomplicated, orderly connection of the conductor to the contact elements after the connection of the contact elements to the insulating strips. A plurality of such strips can then be inserted into a housing and combined with the latter to form a multi-row, e.g. three or four row, plug connector.

7 Claims, 4 Drawing Figures

PLUG CONNECTOR

BACKGROUND OF THE INVENTION

The invention relates to a plug connector having contact elements which in their extension direction are formed of a conductor terminal component and a contact section provided for contact-making with a counter-contact element. A strip-shaped insulating housing is provided into which at least one insulating strip equipped with contact elements can be inserted from one side of the conductor terminal. Transversely to the extension direction of the contact elements, the insulating strip is provided with chambers arranged beside one another. These chambers are laterally bordered by partitions, and are only open towards a flat side of the strip and in the extension direction of the contact elements. A contact element can be inserted therein at least by means of its conductor terminal component.

A plug connector of this type is, for example, disclosed in DE-GM No. 7,146,936, corresponding to U.S. Pat. No. 3,713,073, incorporated herein by reference. The known plug connector serves to connect the individual conductors of an electric flat cable to contact elements which may be connected to corresponding counter-contact elements. The connection of the individual conductors to the contact elements of the connector is carried out prior to the insertion of the contact elements into the chambers of the connector. This is advantageous if a flat cable is connected, because the grid spacing of the contact elements from one another frequently differs from the spacing of the individual conductors at which they rest against one another in the combination of the flat cable. Prior to the insertion into the chambers, the contact elements can be held together by a transverse strip, which can be detached at a later point, at the spacing of the individual conductors of the cable.

SUMMARY OF THE INVENTION

It is an object of the present invention to utilize a plug connector of the type referred to in the introduction in an uncomplicated manner for the connection of the individual conductors of a round cable or individual conductors which extend separately from one another, and where the contact elements are to reliably engage into the insulating strip.

In accordance with the invention, the insulating strips only extend over the length of the conductor terminal component of the contact elements. In the region of their conductor terminal component the contact elements have at least one contacting slot which serves for the insertion of a conductor from the open side of the chambers, and which is bordered by cutting/clamping contact flanks which are transversely directed to the partitions. The contact elements can be locked in the chambers by pressing in a conductor terminal component from the side of the chambers which is continuously open towards the flat side. The cutting and clamping contact flanks form shoulders which abut against the partitions and are overlapped by stop projections of the partitions.

This design of the plug connector allows a particularly simple connection of the contact elements to the insulating strip because a thrust motion is not required, since the chambers are continuously open in the direction of insertion. The specific engagement of the contact elements into the insulating strip allows the holding effect of the stop projections to be additionally improved by pressing a conductor into the contacting slots of the contact elements. The cutting and clamping contact flanks are thus more strongly forced under the stop projections during negligible deflection towards the outside.

It can further be provided within the scope of the invention that each contact element has two contacting slots in the extension direction and a region of the stop projections arranged between the contacting slots is provided with a recess into which the wall component of the contact element engages, at least at one side of the chambers.

Thus, an uncomplicated fixing of the contact elements in the chambers is even achieved in the extension direction of the contact elements. Also, an improvement of the contact-making by a two-fold contact results.

In the following, an exemplary embodiment of a plug connector in accordance with the invention will be further explained, making reference to four figures, each of which are enlarged.

DESCRIPTION OF THE PREFERRED EMBODIMENTS

Figure 1:
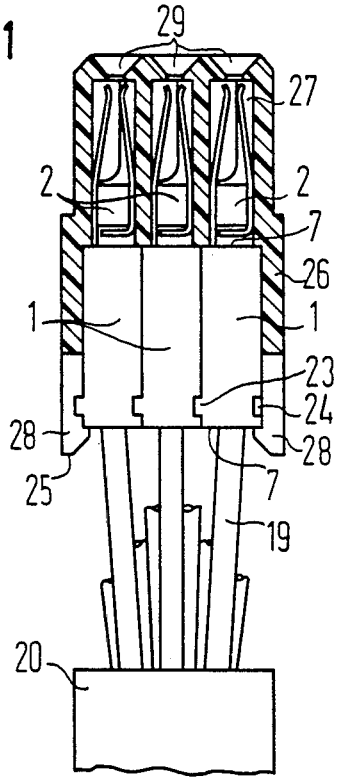
FIG. 1 illustrates a cross-section through a connector connected to the individual conductors of a round cable, the insulating strips of the three-row connector being illustrated in a non-sectional manner.
Figure 3:
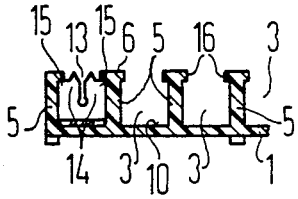
FIG. 3 illustrates a cross-section through an insulating strip with a viewing direction which is parallel to the extension direction of the contact elements.
Figure 2:
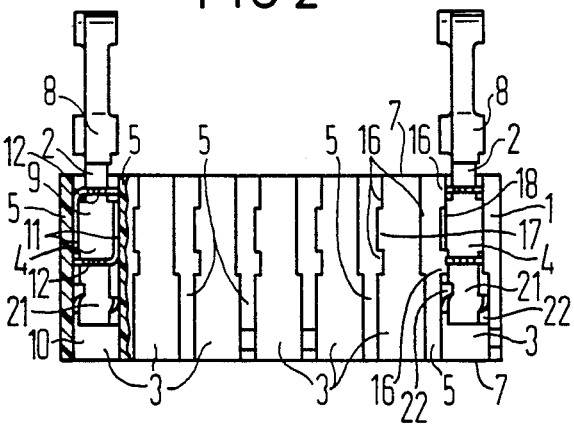
FIG. 2 illustrates an insulating strip viewed from the top with seven chambers which serve to accommodate the conductor terminal components of contact elements.

In particular it can be seen from the figures that the plug connector is constructed with the aid of relatively thin-walled insulating strips 1 which, transversely to the extension direction of contact elements 2, are provided with chambers 3 arranged beside one another. Each chamber 3 is provided for the accommodation of the conductor terminal component 4 of a contact element 2 and laterally bordered by partitions 5. The chambers 3 are open towards a flat side 6 of the strip 1 and in the extension direction of the contact elements 2 on the two boundary walls 7 of the strips directed transversely to the direction of extension of the contact elements 2. As a result of this construction, the strips can be made available as rolled products.

In the extension direction of the contact elements 2 the strips only extend across the region of the conductor terminal components 4 of the contact elements, so that a contact element 2, inserted into a chamber 3 by means of the conductor terminal component 4, freely protrudes over the insulating strip 1 by means of a contact section 8, e.g. a contact spring component provided for the contact-making with a counter-contact element.

The conductor terminal components 4 of the contact elements 2 have a U-shaped profile, whose transverse wall 9 contacts the base 10 of a chamber and whose lateral walls 11 rest against the chamber partitions 5.

Sections 12 of the two lateral walls 11 bent into the region of the U-shaped profile in door-like fashion, form two cutting and clamping contact edges. Each of these has a contacting slot 13 which opens towards the open side of the chamber 3, and is bordered by cutting and clamping contact flanks or edges 14. Thus, the cutting and clamping contact flanks or edges 14 are arranged transversely to the direction of extension of the contact elements 2 and abut on the partitions by means of shoulders 15. Projections 16 arranged at the exposed end of the partitions 5 overlap the shoulders 15 of the cutting and clamping contact flanks or edges, and thereby secure the conductor terminal component of a contact element 2 in the chambers 3 at the open side 6 of the chambers.

Between the cutting and clamping contact edges spaced from one another at a specific distance, the projections 16 of a partition 5 are provided with a recess 17. A correspondingly dimensioned section 18 of a lateral wall 11 of the U-shaped profile of the contact elements 2 fits into said recess. Thus, the contact element is secured in the chamber 3 in the extension direction, because when the conductor component 4 of a contact element 2 is inserted into one of the chambers 3, the wall section 18 is locked into the recess 17 of the projections 16.

Each contact element 2 can be pressed into a chamber 3 of the insulating strip 1 continuously open between the walls 7, by means of its conductor terminal component 4 where the projections 16 first diverge to a small extent. When the transverse wall 9 rests against the chamber base 10, the projections 16 project over the shoulders 15 of the cutting and clamping contact flanks 14, and thus lock the contact element 2 in the chamber 3 opposite to the direction of insertion.

A conductor 19, e.g. of a round cable 20, can be pressed into the two cutting and clamping contact points of the contact element 2 which are respectively realized by a contacting slot 13. With the aid of a conductor gripping section 21 of the conductor terminal component 4, a conductor connected by means of the cutting and clamping contact points of the contact element 2 can be additionally connected to the contact element 2. The conductor gripping section 21 is arranged at the end of the contact element 2 which faces away from the contact section 8. Lugs 22 which protrude from the lateral walls 11 of the conductor terminal component 4 towards the flat side 6 are squeezed against the conductor which is pressed against the base of the U-profile.

Figure 4:
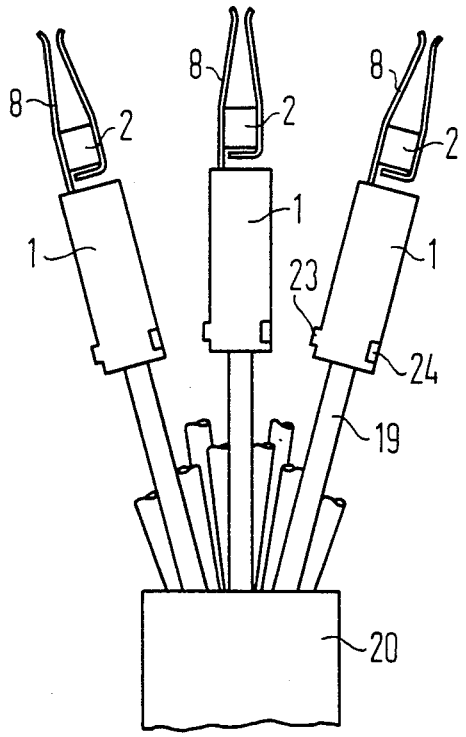
FIG. 4 illustrates from the side three insulating strips equipped with contact elements, the contact elements being connected to the individual conductors of a round cable prior to the assembly of the insulating strips and the insertion of the joined insulating strips into a housing of a plug connector.

An insulating strip 1 which is fully or partially equipped with contact elements can now be interlocked with further similar insulating strips 1, as illustrated in FIGS. 1 and 4, where projections 23, arranged on the flat sides of the strips, are inserted into correspondingly designed recesses 24. The insulating strips are thereby joined to one another in the direction of extension of the contact elements 2.

A pack of insulating strips 1 formed in this manner, for example, from three insulating strips 1, can now be inserted into a matching insulating housing 26 from the side 25 of the conductor terminal. The contact sections 8 of the individual contact elements 2 which are fixed in the individual insulating strips 1, thereby penetrate channel-like recesses 27 arranged in the insulating housing 26.

Stop hooks 28 arranged on the side 25 of the conductor terminal of the insulating housing 26, finally overlap the walls 7 of the two outer insulating strips 1. The walls 7 face away from the contact sections 8 and thereby secure the pack of insulating strips in the insulating housing 26.

The contact sections 8 of the two contact elements 2 are accessible by means of insertion openings 29 arranged on the side of the insulating housing 26 which faces away from the side 25 of the conductor terminal.

Although various minor changes and modifications might be proposed by those skilled in the art, it will be understood that I wish to include within the claims of the patent warranted hereon all such changes and modifications as reasonably come within my contribution to the art.

I claim as my invention:

1. A plug connector, comprising:

contact elements each having in a longitudinal extension direction at one end a conductor terminal section means for connection to a wire conductor and at an opposite end a contact section means for contact-making with a counter-contact element;

an insulating strip having a plurality of U-shaped chambers formed by a base and respective lateral walls, each chamber receiving one of said contact elements;

each chamber extending substantially only over a length of the conductor terminal section means of each contact element so as to encompass substantially only the conductor terminal section means and the contact section means of each contact element extending beyond the chamber and free of the strip;

said conductor terminal section means comprising at least one contacting slot means into which a respective wire conductor can be inserted from an open side of the chambers for contacting the wire;

means interacting with the conductor terminal section means of each contact element for retaining the contact element in the chamber both in a direction perpendicular to the chamber base and in a longitudinal direction of extension of each chamber; and insulating housing means joined to the insulating strip for receiving the free contact section means of each contact element.

2. A plug connector according to claim 1 wherein said contacting slot means comprises cutting and clamping contact flanks transverse to the chamber lateral walls and wherein said means for retaining comprises a stop projection overlying shoulder portions of the cutting and clamping contact flanks.

3. A plug connector according to claim 2 wherein said means for retaining further comprises a recess in at least one of the lateral chamber walls and a corresponding projecting section of the contact element at said connector terminal section means.

4. A plug connector according to claim 1 wherein a plurality of said insulating strips are provided adjacent one another so as to form a stack, the stack being received in a portion of said insulating housing means.

5. A plug connector according to claim 4 wherein the insulating housing means has a plurality of chambers for receiving the contact section means of each contact element, and means for locking the plurality of insulating strips in the insulating housing.

6. A plug connector according to claim 1 wherein the conductor terminal section means comprises first and second bent sections of the contact element which are transverse to said longitudinal extension direction of each contact element and wherein each bent section has a contact slot therein.

7. A plug connector, comprising:

contact elements each having in a longitudinal extension direction at one end a conductor terminal section means for connection to a wire conductor and at an opposite end a contact section means for contact-making with a counter-contact element inserted into said contact section means in said longitudinal extension direction;

an insulating strip having a plurality of U-shaped chambers formed by a base and respective lateral walls, each chamber receiving one of said contact elements;

each chamber extending substantially only over a length of the conductor terminal section means of each contact element, and the contact section means of each contact element extending beyond the chamber and free of the strip;

said conductor terminal section means comprising at least one cutting and clamping contact flank having a contacting slot means into which a respective wire conductor can be inserted in said longitudinal extension direction from an open side of the chambers for contacting the wire;

stop projection means on the chamber walls for retaining the contact element in the chamber in a direction perpendicular to the chamber base and in a longitudinal direction of extension of each chamber; and insulating housing means joined to the insulating strip for receiving the free contact section means of each contact element.

* * * * *